United States Patent [19]

Huotari

[11] 4,443,958

[45] Apr. 24, 1984

[54] MEANS FOR REMOVING SNOW FROM ROAD

[76] Inventor: Veijo E. Huotari, Kauppakatu 29 A 11, SF-87100 Kajaani 10, Finland

[21] Appl. No.: 370,616

[22] Filed: Apr. 22, 1982

[30] Foreign Application Priority Data

Apr. 28, 1981 [FI] Finland ..... 811324

[51] Int. Cl.[3] ..... E01H 5/09

[52] U.S. Cl. ..... 37/238; 37/250

[58] Field of Search ..... 37/227, 248, 255, 257, 37/250, 228, 229, 238

[56] References Cited

U.S. PATENT DOCUMENTS

| | | | |
|---|---|---|---|
| 864,151 | 8/1907 | Blaisdell | 37/257 X |
| 1,508,716 | 9/1924 | Ochs | 37/257 X |
| 2,066,207 | 12/1936 | Lestina | 37/255 |
| 2,977,955 | 4/1961 | Altenburg | 37/227 X |
| 3,876,055 | 4/1975 | Tyznik | 37/257 X |

FOREIGN PATENT DOCUMENTS

| | | | |
|---|---|---|---|
| 603735 | 8/1960 | Canada . | |
| 808977 | 3/1969 | Canada | 37/227 |
| 1155462 | 10/1963 | Fed. Rep. of Germany | 37/248 |
| 2057266 | 5/1972 | Fed. Rep. of Germany | 37/248 |
| 1099737 | 1/1968 | United Kingdom | 37/257 |
| 583232 | 12/1977 | U.S.S.R. | 37/257 |

*Primary Examiner*—Edgar S. Burr
*Assistant Examiner*—Moshe I. Cohen
*Attorney, Agent, or Firm*—Andrus, Sceales, Starke & Sawall

[57] ABSTRACT

A means for removal of snow and/or ice from a road or other equivalent area, meant to be attached to a work machine, said means comprising a helical cutter (10) disposed substantially transversally to the direction of travel of the work machine, a drive means (11) for rotating the cutter about its central axis (12), and members (6,7,8) for collecting the material detached by the cutter (10) and for their removal from the ground and transportation onto a load platform (9). The object is to eliminate the drawback encountered in means of this kind that it is not possible with them to remove the snow and ice simultaneously from the carriage-way and pavements and from behind traffis signs, posts and other similar obstacles.

As taught by the invention, the means comprises a rotating side cutter (10) provided with controls (13,13') for displacing the side cutter in the height direction and in the direction of its axis, and preferably an end cutter (30) which has been mounted crosswise with the cutter (10) preferably on the outer end thereof and has been provided with a drive means (31) for rotating the cutter about its central axis (32). The end cutter has been disposed preferably pivotally with reference to the helical cutter (10) and provided with a force means (34) so that the end cutter is turnable up and into horizontal position.

4 Claims, 6 Drawing Figures

MEANS FOR REMOVING SNOW FROM ROAD

The invention concerns a means for removing snow and/or ice from a road or other equivalent area, intended to be attached to a work machine and comprising a substantially horizontal helical cutter, a power means for rotating the cutter about its central axis, control means for displacing the cutter in the height direction, and members for collecting the material detached by the cutter and for its removal from the ground and for its transportation onto a load platform.

BACKGROUND OF THE INVENTION

Means of this type, and other means aiming to serve the same end, are known e.g. through the German Pat. No. 1 924 514, the U.S. Pat. Nos. 1,739,331, 2,221,386, 3,308,563 and 3,333,354.

These means of prior art are encumbered by the drawback that the carriage-way and pavement cannot be simultaneously cleaned. Moreover, the member detaching the snow or ice cannot be moved behind a traffic sign, lamp-post or other similar obstacle, and therefore the areas behind said obstacles remain totally uncleared of snow or ice. In the case of pavements and carriage-ways such snow and ice accumulations remaining behind traffic signs, posts or similar obstacles cause serious impediment of vehicular traffic and/or pedestrian traffic.

SUMMARY OF THE INVENTION

The object of the present invention is to eliminate the drawbacks mentioned. It is a further object of the invention to provide a means which is usable towards ice removal from roads and pavements simultaneously in such manner that traffic signs, lamp-posts and other equivalent obstacles cause no detriment to ice removal.

Regarding the features which are characteristic of the invention, reference is made to the claims section.

DESCRIPTION OF THE DRAWINGS

The invention is described in detail in the following with the aid of embodiment examples, reference being made to the attached drawing, wherein.

DESCRIPTION OF THE ILLUSTRATED EMBODIMENT

Figure 1:
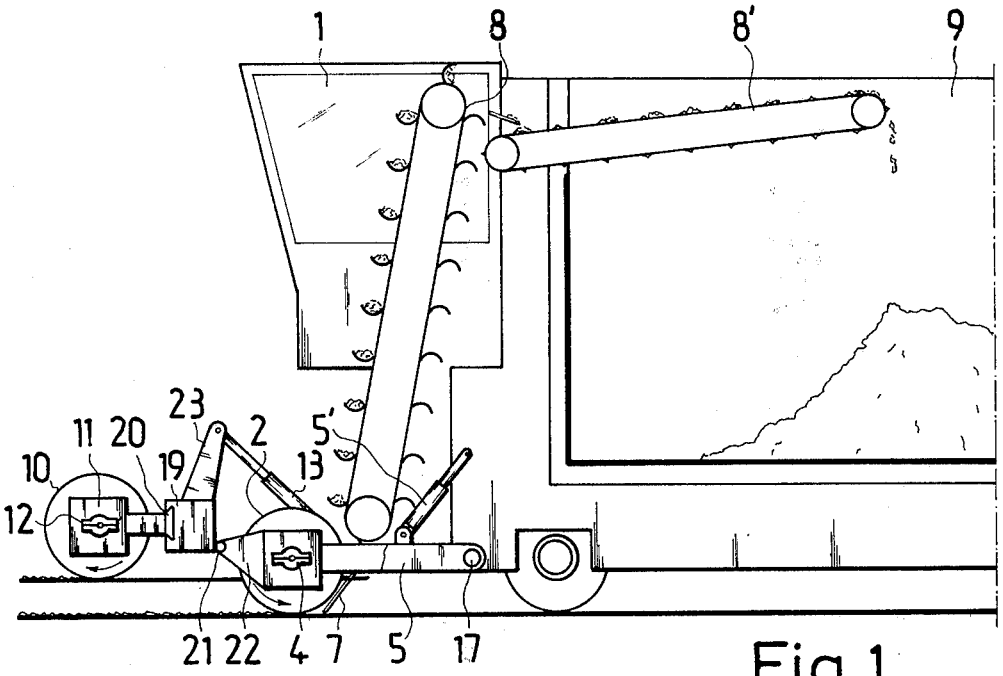
FIG. 1 presents in elevational view, a means according to the invention for removal of ice from a road.

The means for removing ice and snow from a road, according to one embodiment of the invention, depicted in FIG. 1 comprises a mainly cylindrical and centric helical cutter 2 disposed in the horizontal plane and attached to a work machine 1, such as a truck with its load platform 9. The helical cutter 2 has been mounted in front of the work machine 1 against the road base and transversally with reference to the road base. The cutter 2 is provided with a drive 3, such as a hydraulic motor, for the purpose of rotating the cutter about its central axis 4, and with controls 5' for displacing the cutter in vertical direction.

In the embodiment depicted, the cutter 2 has been connected to the work machine 1. By the aid of rigid arms 5 parallelling the work machine and at right angles to the cutter, at both ends of the cutter, said arms being pivotally attached to the frame of the work machine by pivots 17 permitting vertical pivotal movement. The arms 5 have been provided with force means 5' such as a hydraulic cylinder attached by one end to the frame of the work machine and by the other end to the respective arm, these force means being used to lift and lower the cutter in front of the work machine. The hydraulic motor 3 and hydraulic cylinder 5' have been hooked up with the hydraulic system of the work machine, the tubing being omitted in the figure for better illustration of the construction.

The means of FIG. 1 furthermore comprises the members 7, 8 and 8' for collecting the material detached by the cutter 2 and picking it off the ground and conveying it onto the load platform 9.

The means depicted in FIG. 1 comprises in addition to the cutter 2, that is the main cutter 2, a side cutter 10, provided with a drive 11, such as a hydraulic motor, serving to rotate cutter 10 about its central axis 12, and with a control means 13 for displacing the cutter in the vertical direction and in its axial direction. The arms 5 carrying the main cutter carry furthermore the operating frame 19 of the side cutter 10, parallel to the main cutter; on the frame 19 guides have been provided for displacing the side cutter along said guides, carried by the slide 20 and actuated by the hydraulic cylinder 13, so that the side cutter is displaceable in lateral direction with reference to the main cutter. The operating frame 19 has been pivotally carried by supports consisting of extensions 22 of the main cutter's supporting arms 5, with the aid of the pivot 21, to be pivotable in vertical direction, and they have been provided with power cylinders 13 connected to the main cutter carrying arms 5 on one hand and on the other hand to lugs 23 provided on the operating frame 19 of the side cutter 10 so that the operating frame 19 with side cutter 10 is liftable and lowerable about the pivot 21 with the aid of the cylinders 13.

Figure 2:
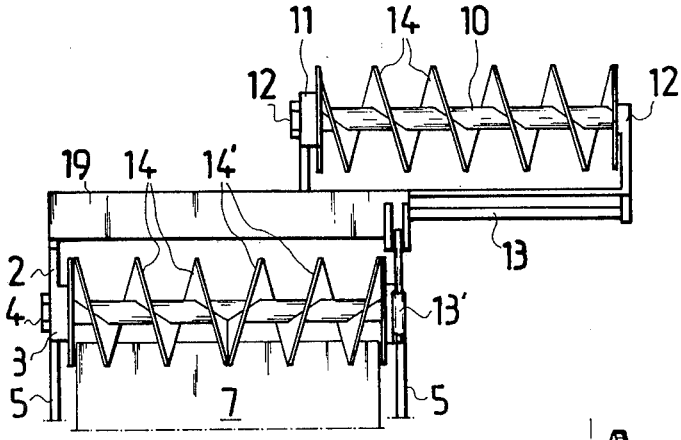
FIG. 2 presents in top view, another means according to the invention, connectable to a work machine.

The application depicted in FIG. 2 corresponds to that shown in FIG. 1, regarding the construction and placement of the main cutter 2 and side cutter 10. The main cutter 2, as in the example of FIG. 1, has been provided with a hydraulic motor 4 and control arms 5 including hydraulic cylinders 5' (these latter not visible in the figure) for rotating the main cutter and for lifting and lowering it.

Figure 3:
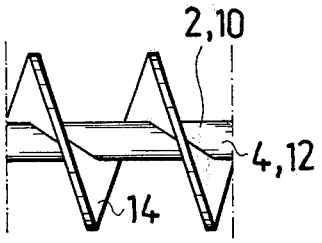
FIG. 3 shows in partial enlarged presentation, the blade of the cutter belonging to the means of FIG. 2.

FIG. 3 shows the construction of the cutter 2, 10 of a means according to the invention, on an enlarged scale. The cutter 2, 10 has been provided with a helical blade surface 14 parallelling the axis 4, 12 and running around the surface of the cutter. As it rotates, rotated by the power means 3, 11, the blade surface breaks the ice and moves it in the direction of the helix thanks to the helical shape of the blade surface. The direction of the pitch of the helix 14 may be so disposed (FIG. 2) that the helix 14 of the side cutter 10, as the side cutter is rotating in front of the main cutter, will move the detached ice to be in front of the main cutter; the helix on the end of the main cutter adjacent to the side cutter has been arranged to move the ice from the direction of the side cutter towards the other end of the main cutter; the helix 14' on this latter end is opposite of its direction to the helix 14 on the first end of the main cutter and it has been arranged to move the ice in the direction of the side cutter. Hereby the material dislodged by the side cutter 10 will move in the direction of the main cutter, and the material dislodged by the main cutter and that which has been transported from the side cutter to the main cutter go to the point where the helices of different direction of the main cutter's blade surfaces come together, and thence through under the main cutter to the detached material collecting members, such as the collecting blade 7.

Figure 4:
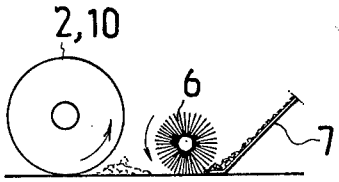
FIG. 4 presents a third means according to the invention, in elevational view and schematically depicted.

In the embodiment depicted in FIG. 4 there has been mounted on the rear side of the main cutter 2, that is on its side towards the vehicle 1, a conventional rotating brush means, which has been disposed to move the material detached by the cutter blade onto the collector blade 7.

Figure 5:
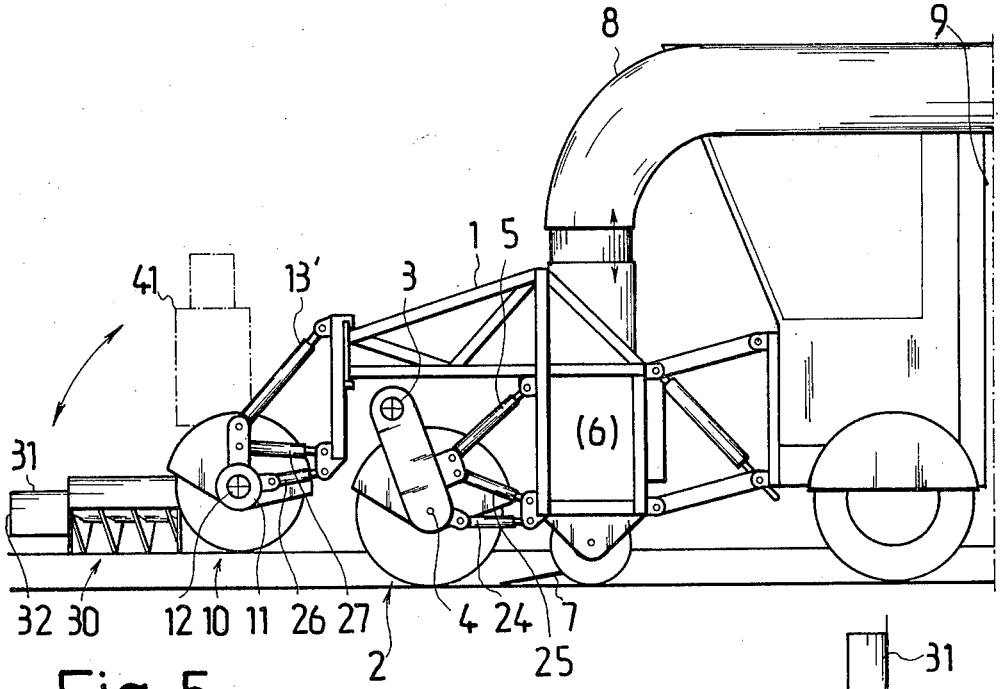
FIG. 5 presents a fourth means according to the invention, attached to a work machine.
Figure 6:
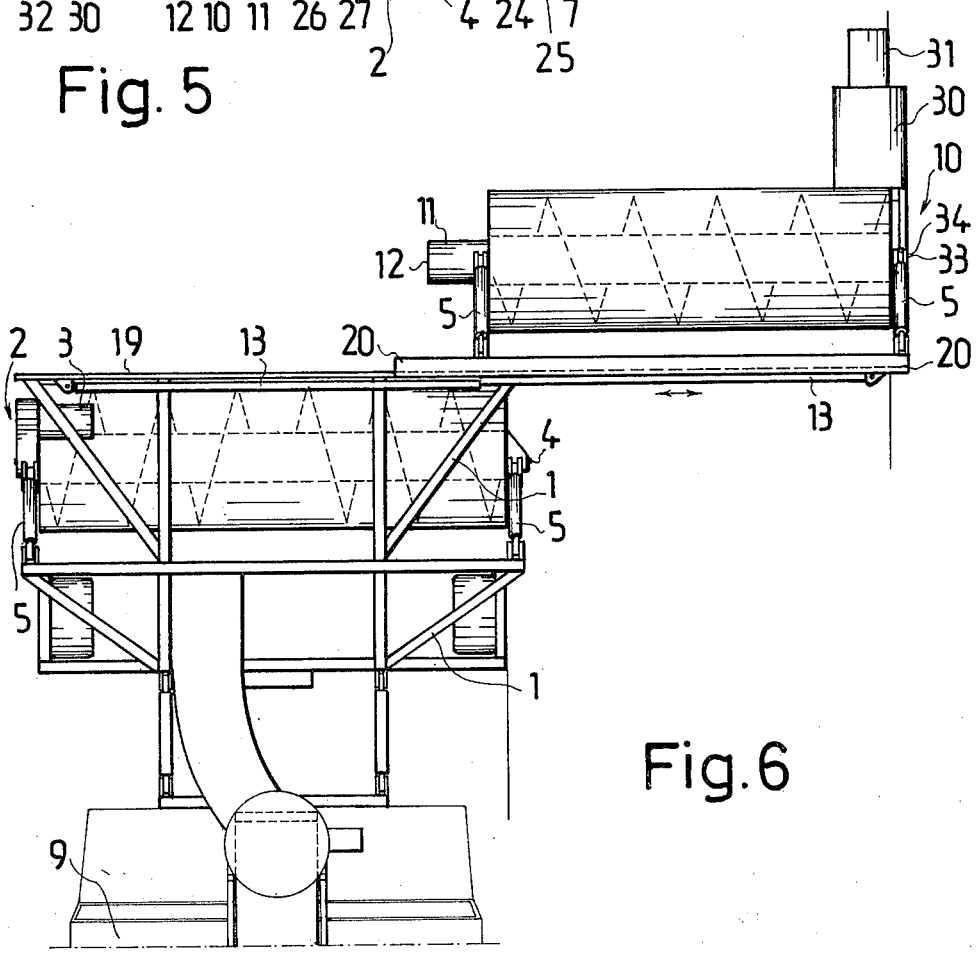
FIG. 6 presents the means of FIG. 5 from above.

FIGS. 5–6 illustrate a means according to the invention for removal of snow and ice from a road, attached in front of a work machine, such as a truck provided with load platform 9. The means generally conforms to the means which are presented in FIGS. 1–2 as to its design. In addition, it comprises an ice collecting member 7, a centrifugal blower 6 (not visible in the figure) and a duct 8 for collection of the snow and ice detached by the cutters 2, 10 and for its removal from the ground and transportation onto the load platform 9.

The means depicted in FIGS. 5–6 furthermore comprises an end cutter 30, which is horizontal in the figure and placed substantially normal to the side cutter 10, preferably on the outer end thereof. The end cutter 30 has been provided with a drive means 31, such as e.g. a hydraulic motor, for rotating the cutter about its central axis 32. Furthermore, the end cutter has been disposed to be pivoted with reference to the side cutter 10 and it has been provided with a force means 34, such as a hydraulic cylinder, (visible in FIG. 6) so that the end cutter can be pivoted up (indicated with dotted lines 41 in FIG. 5) and to be horizontal as shown in FIG. 5. It is then possible, as desired, to lower the end cutter down, that is towards the direction of travel of the work machine and to touch the ground in front of the transversal side cutter 10 on one side and to the other end of the cutter with the aid of a force means, such as the toothed cylinder 34.

FIG. 6 illustrates the placement of the end cutter 3 on the outermost end of the displaceable side cutter 10 substantially at right angles forward, that is pushed in the direction of travel of the work machine. The end cutter is connected by pivots 33 to the outer end of the side cutter to be lowerable and liftable in the way described.

In FIG. 6 the frame 1 carrying the cutters 2, 10 has been provided with sliding elements, such as a rail 19 and a slide member 20, by mediation of which the displaceable side cutter 10 is connected to the frame 1. Furthermore, the displaceable side cutter has been provided with a force means 13, such as a horizontal hydraulic cylinder for instance, by the aid of which the cutter 10 may be displaced laterally with reference to the other cutter, i.e., the substantially fixed main cutter 2.

In FIGS. 5–6 the cutters 2, 10 have been provided with controls 5, 13' and with tilting elements 24, 25, 26, 27, such as hydraulic cylinders, for displacing the cutters in the vertical direction with reference to each other and to the ground and for tilting the cutters with reference to each other and to the ground.

If desired, the cutters may comprise separate detachable and exchangeable blade elements, as is known e.g. through chipping means, wood-dressing cutters and other equivalent kinds of apparatus. The blade elements may be disposed in resemblance of the helical blade surface 14 presented, in helical configuration, in which case the blades may be disposed to move the detached material to the collector members.

The means of the invention is eminently suitable for use in the simultaneous cleaning of roads and pavements. The main cutter may be used to clean the carriage-way while at the same time the side cylinder is used towards cleaning the pavement. When a traffic sign or lamp-post or another similar obstacle is encountered, the side cutter may be moved to be in front of the main cutter until the obstacle has been passed. When the pavement is at a higher elevation than the roadway, the side cutter may by the aid of its controls be lifted to a height consistent with that of the pavement, at the same time keeping the main cutter on a height consistent with the roadway plane.

By virtue of the invention, the areas behind traffic signs, lamp-posts or other equivalent obstacles can be easily cleaned with the aid of the end cutter belonging to the means. The means is simple of its construction and reliable in service and commands a reasonable price.

The invention is not confined to the embodiment examples presented: its embodiments may vary within the scope of the claims following below. The direction of rotation of the cutter blades may be changeable, as well as their speed of rotation; the cutter blades may consist e.g. of two concetric parts rotating in different directions.

I claim:

1. An apparatus for removing snow and/or ice from a roadway, comprising a mobile vehicle, a substantially horizontal helical first cutter mounted on the vehicle and extending laterally of the direction of movement of said vehicle, drive means for rotating said first cutter around its axis, first pivot means for pivoting said first cutter in a vertical direction, operation of said first cutter serving to dislodge ice and/or snow from said roadway, delivery means for conducting the dislodged ice and/or snow to a collection site, a second helical cutter disposed generally parallel to said first cutter and located ahead of said first cutter, a frame connected to said vehicle, guide means on said frame for guiding the second cutter in movement relative to said first cutter in a direction parallel to the axis of said first cutter from an extended position where the second cutter extends outwardly beyond the first cutter to a retracted position where the second cutter is in substantial registry with the first cutter, displacement means for moving said second cutter between said retracted and extended positions, and second pivot means for pivoting the second cutter relative to said guide means in a vertical direction and including an end cutter disposed generally horizontal and extending normal to said second cutter, said end cutter disposed adjacent an end of said second cutter.

2. The apparatus of claim 1, wherein the ends of the helical first cutter have opposite pitch, whereby ice and/or snow is delivered from the ends of said first cutter toward the center thereof, said delivery means being disposed adjacent the center of said first cutter.

3. The apparatus of claim 1, and including third pivot means for pivoting said end cutter in a vertical direction.

4. The apparatus of claim 3, wherein the end cutter is connected to said second cutter so that said end cutter and said second cutter are movable in unison with respect to the first cutter on operation of said displacement means.

* * * * *